United States Patent [19]
Wutz
[11] 4,100,385
[45] Jul. 11, 1978

[54] ELECTRICAL TERMINAL, PARTICULARLY PLUG-TYPE TERMINAL

[75] Inventor: Max Wutz, Hanau (Main), Fed. Rep. of Germany

[73] Assignee: W. C. Heraeus GmbH, Hanau, Fed. Rep. of Germany

[21] Appl. No.: 705,917

[22] Filed: Jul. 16, 1976

[30] Foreign Application Priority Data

Aug. 20, 1975 [DE] Fed. Rep. of Germany ..... 2536985

[51] Int. Cl.[2] ..... H01H 1/02

[52] U.S. Cl. ..... 200/268; 200/262; 200/267; 200/270; 339/278 C; 428/550; 428/548

[58] Field of Search ..... 339/278 C; 200/267, 200/268, 269, 262, 270; 29/182; 428/550, 548, 551

[56] References Cited

U.S. PATENT DOCUMENTS

| | | | |
|---|---|---|---|
| 1,904,241 | 4/1933 | Kammerer | 200/269 |
| 3,617,990 | 11/1971 | Colardeau | 339/278 C |

FOREIGN PATENT DOCUMENTS

| | | | |
|---|---|---|---|
| 2,024,074 | 5/1971 | Fed. Rep. of Germany | 339/278 C |

*Primary Examiner*—Benjamin R. Padgett
*Assistant Examiner*—J. L. Barry
*Attorney, Agent, or Firm*—Flynn & Frishauf

[57] ABSTRACT

To reduce costs and permit use of a smaller amount of noble metals in nobel metal contacts, a common metal contact material which forms, in an oxygen-containing atmosphere or in air, non-porous insulating oxides, is coated with a porous noble metal or noble metal alloy cover layer, the pores or regions not covered by the noble metal or nobel metal alloy being permitted to oxidize to form a protective common metal contact material oxide, the noble metal regions in contact with the underlying contact material itself providing for the electrical connection. Preferably, the porous cover layer has a thickness of between about 0.1 to 0.2 μm, and the contact material, separately or applied to a carrier, has a thickness of between 2 to 100 μm, preferably about 10 μm, and comprises aluminum, titanium, niobium, chromium, silicon, zirconium or tantalum, the noble metal preferably being gold or a gold alloy, applied under exclusion of oxygen to the underlying contact material after any oxide skin thereon has been removed.

13 Claims, 1 Drawing Figure

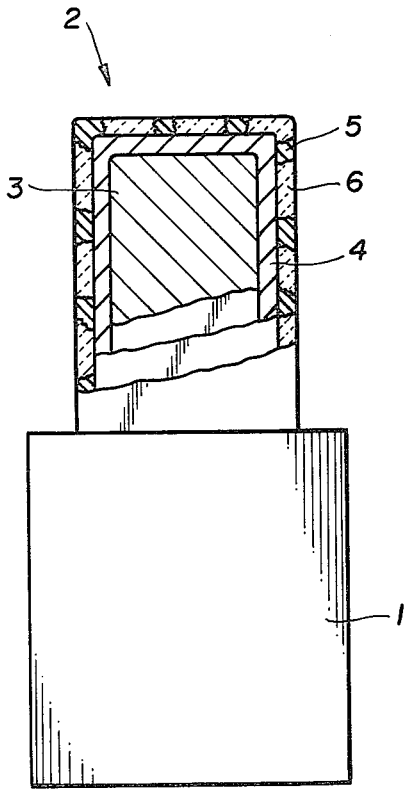
2
5
3
6
4
1

ELECTRICAL TERMINAL, PARTICULARLY PLUG-TYPE TERMINAL

Cross reference to related applications:

U.S. Ser. No. 705,918, filed July 16, 1976, Inventors: Nils HARMSEN et al (claiming priority of German Application P 25 40 956.7-34 of Sept. 13, 1975); U.S. Ser. No. 705,919, filed July 16, 1976, Inventors: Nils HARMSEN et al (claiming priority of German Application P 25 40 943.2-34 of Sept. 13, 1975), all assigned to the assignee of the present application.

The present invention relates to an electrical terminal and particularly to a plug-connection terminal which has a layer of contact material applied to a substrate to provide the contact area of the terminal itself.

It has previously been proposed to use corrosion-resistant metals as contact terminal material. The group of the corrosion-resistant metals includes not only noble metals and alloys based on noble metals, but also common metals which form a non-porous oxide layer in air, or in other oxygen-containing atmosphers, protecting the respective common metal against corrosion. Typical examples of such metals are aluminum, titanium, niobium, chromium, magnesium, silicon and zirconium. These metals, such as pure aluminum, for example, and aluminum alloys cannot be used as exposed contact material — in a narrow sense — due to the oxide layer which is electrically insulating and always present. The poor contact characteristics of aluminum, for example, can be improved by using rolled aluminum which is plated, in the rolling process on at least one or on both facing sides with a copper layer. The surface characteristics of the contact material are then determined by the coating or cover layer.

It is an object of the present invention to provide electrical contacts which permit the use of common metals, that is, metals other than noble metals, and which form in air or other oxygen-containing atmospheres an oxygen compound layer which is non-porous but still has good electrical terminal characteristics.

Subject matter of the present invention: The contact terminals, particularly plug-connections, have a contact layer of a common metal which forms in air or in other oxygen-containing atmospheres a non-porous oxide layer; it further includes a porous cover layer of about 0.01 to 1 $\mu$ m thick, of a noble metal or a noble metal alloy; at the points of porosity, that is, at the pores between the noble metal itself, the contact layer will show the oxide of the common metal.

Noble metals which are particularly useful are gold, silver, platinum, palladium and ruthenium; noble metal alloys are alloys which are based on the above-named noble metals. Gold and gold alloys are particularly suitable for the contacts of the present invention. The porous cover layer of the noble metal or noble metal alloy, preferably, has a thickness of about 0.1 $\mu$ m. The common metal for the contact layer may be aluminum, titanium, niobium, chromium, silicon, zirconium or tantalum. Aluminum, titanium, niobium and chromium are particularly suitable. The thickness of the contact layer is in the range of from 2 to 100 $\mu$ m, and preferably about 10 $\mu$ m.

The invention will be described by way of example with reference to the accompanying drawings, wherein the single is a schematic cross section through the contact blade of a plug terminal.

A plug housing 1 has a plug terminal 2 extending therefrom. The plug terminal 2 has an inner substrate or support or carrier 3 as a contact layer 4 thereon. Contact layer 4 is covered with an outer layer which is a composite of regions formed of regions 5 of noble metals or noble metal alloys, and regions 6 formed of an oxide of the metal of layer 4, that is, an oxide of the common metal.

The contacts for use in the present invention may be used for any contacting application in which electrical terminals are used. The carrier material for the support 3 preferably is a metal which is customarily used for electrical plug or switch terminals or other terminal uses; specifically, it may be a metal of the group of bronze, German silver (nickel silver), brass, copper-beryllium, and the like.

The actual contact surface formed of regions 5 and 6 is a cover coating built up of a mosaic of adjacent regions or zones 6 of the electrically insulation oxide of the base metal 4 and the electrically conductive noble metals (or noble metal alloys) shown at 5. This composite surface provides electrical contacts which meet the requirements of corrosion resistance, effected by the common metal oxides 6 as well as by the noble metal (or noble metal alloy) regions 5. The regions 5 act, in operation, similar to contacting bridges which bridge over the regions of oxides 6. Thus, the inherently insulating oxide regions are made, effectively, electrically conductive. Low contact resistance is ensured by the metallic connection of the regions 5, of noble metal or noble metal alloy, with layer 4 and, in turn, the metal carrier 3 to which other electrical connections can be made.

The electrical contact is preferably made by use of coating processes which are carried out under decreased pressure, such as vapor deposition or cathodic sputtering.

Process of making a contact: A suitably cleaned carrier material 3, cleaned in accordance withwell known and customary processes and made, for example, of bronze, German silver, brass, or copper beryllium, is placed in high vacuum. Under exclusion of oxygen, a contact layer such as niobium, that is, of a common and non-noble metal, is applied from a vapor phase until about 10 $\mu$ thickness have precipitated, thus forming layer 4. The high vacuum is maintained, that is, without introducing oxygen at this process, a cover layer of about 0.1 $\mu$ thickness, of a noble metal or a noble metal alloy, is applied to form regions 5. This metal is, for example, gold or a gold alloy,. It is vapor deposited on the layer 4. It has been found advantageous to clean the surface of the contact layer 4, as known, by ion bombardment before vapor deposition the noble metal thereon. After the so coated carrier is taken out of the high-vacuum apparatus, the pores will form an oxide by contact with the air, thus forming an oxide of the underlying material 4, in the example selected, niobium oxide.

The contact can also be used without a sub-carrier 3; it may consist only of the common, non-noble metal 4 which forms in free air or other oxygen-containing atmosphere a non-porous oxide layer. To make such a contact, the carrier is treated to remove any possibly non-porous oxide coating or skin therefrom, for example by means of cathodic sputtering processes, before the porous cover layer of noble metal or noble metal alloy can be applied thereto.

The porous cover layer of noble metal or noble metal alloy may also be applied by processes other than vapor deposition metods, for example by galvanic deposition.

Without interrupting electrolytic deposition, chromium, for example, is first applied to a carrier and thereafter a porous cover layer of gold is deposited on the chromium. It is desirable to work by means of pumped circulating electrolyte during the deposition step, since this provides the opportunity to immediately switch over from a chromium containing electrolyte to a gold-containing electrolyte. The deposition of the chromium layer, and thereafter of the gold layer, may also be effected by using two separate galvanic baths, while transporting the carrier, already coated with chromium in a protective gas and application of an electric voltage in a rinse before introducing the carrier in the gold bath.

The carrier need not be coated completely, but only that portion of its surface which forms the contact area itself when in use.

I claim:

1. Electrical terminal which comprises at least in the range or region of contact a layer of a contact material, which is at least one material selected from the group consisting of aluminum, titanium, niobium, chromium, silicon, zirconium and tantalum (4) which, in air or oxygen-containing atmosphere, forms a non-porous oxide skin covered with a contact surface comprising;

a porous cover layer (5) of from between 0.01 to 1 μm thick noble metal or noble metal alloy on the surface of said contact material to form an electrical conductive connection therewith;

and an oxide (6) of the contact material integral with said contact material located in the pores of the porous noble metal or noble metal alloy.

2. Terminal according to claim 1, wherein the porous noble metal or noble metal alloy layer (5) has a thickness of from between 0.1 to 0.2 μ m.

3. Terminal according to claim 1, wherein the porous layer (5) comprises a gold or gold alloy.

4. Terminal according to claim 1, wherein the contact material (4) has a thickness of from 2 to 100 μ m.

5. Terminal according to claim 4, wherein the contact layer (4) has a thickness of about 10 μ m.

6. Terminal according to claim 1, further comprising a support carrier (3), the contact material (4) being applied to the support carrier and in electrical contact therewith.

7. Terminal according to claim 6, wherein the contact carrier (3) comprises a material selected from the group of at least one of: bronze, German silver, brass, copper-beryllium;

the contact material (4) comprises niobium;

and the porous cover layer (5) comprises gold or a gold alloy, the pores between the gold or gold alloy being formed of niobium oxide (6).

8. Electrical terminal which comprises at least in a contact portion thereof a layer having a thickness of from 2 to 100 μ m of a contact material which is at least one material selected from the group consisting of aluminum, titanium, niobium, chromium, silicon, zirconium, and tantalum and a contact surface comprising;

a porous cover layer of from between 0.01 to 1 μ m thick of a noble metal or noble metal alloy on the surface of said contact material to form an electrical conductive connection therewith; and an oxide of the contact material integral with said contact material located in the pores of said porous noble metal or noble metal alloy.

9. Terminal according to claim 8 wherein said porous noble metal or noble metal alloy layer is a porous gold or gold alloy layer having a thickness of from between 0.1 to 0.2 μ m.

10. Terminal according to claim 9 wherein said contact layer is a layer of niobium having a thickness of about 10 μ m.

11. Terminal according to claim 10 further comprising a support carrier with said contact material being coated on said support carrier and in electrical contact therewith; said support carrier comprising at least one material selected from the group consisting of bronze, German silver, brass, and copper-beryllium.

12. Terminal according to claim 11 in the form of a plug contact.

13. Terminal according to claim 8 in the form of a plug contact.

* * * * *

UNITED STATES PATENT AND TRADEMARK OFFICE

CERTIFICATE OF CORRECTION

PATENT NO. : 4,100,385

DATED : July 11, 1978

INVENTOR(S) : MAX WUTZ

It is certified that error appears in the above-identified patent and that said Letters Patent are hereby corrected as shown below:

Claim 13, line 1, replace "Terminal according to claim 8..."

with ---Terminal according to claim 12...---.

Signed and Sealed this

*Fourth* Day of *December 1979*

[SEAL]

*Attest:*

SIDNEY A. DIAMOND

*Attesting Officer*

*Commissioner of Patents and Trademarks*